US011079202B2

(12) United States Patent
Moseman et al.

(10) Patent No.: US 11,079,202 B2
(45) Date of Patent: Aug. 3, 2021

(54) BORESIGHTING PERIPHERALS TO DIGITAL WEAPON SIGHTS

(71) Applicant: Sensors Unlimited, Inc., Princeton, NJ (US)

(72) Inventors: Samuel Moseman, Orange, CA (US); Mathew Canahuati, Corona, CA (US)

( * ) Notice: Subject to any disclaimer, the term of this patent is extended or adjusted under 35 U.S.C. 154(b) by 291 days.

(21) Appl. No.: 16/029,586

(22) Filed: Jul. 7, 2018

(65) Prior Publication Data

US 2020/0011640 A1 Jan. 9, 2020

(51) Int. Cl.
*F41G 1/54* (2006.01)
*F41G 3/06* (2006.01)
*F41G 1/38* (2006.01)

(52) U.S. Cl.
CPC ..... *F41G 1/54* (2013.01); *F41G 3/06* (2013.01); *F41G 1/38* (2013.01)

(58) Field of Classification Search
CPC ..... F41G 1/54; F41G 3/06; F41G 1/38; F41G 3/165; F41G 3/326
See application file for complete search history.

(56) References Cited

U.S. PATENT DOCUMENTS

| | | | |
|---|---|---|---|
| 2,452,592 | A | 11/1948 | Meyer |
| 2,627,659 | A | 2/1953 | Murr |
| 2,901,750 | A | 9/1959 | McMurry |
| 2,901,751 | A | 9/1959 | Gales et al. |
| 2,908,943 | A | 10/1959 | Miller |
| 3,320,619 | A | 5/1967 | Lastnik et al. |
| 3,413,656 | A | 12/1968 | Vogliano et al. |
| 3,419,334 | A | 12/1968 | Hubbard |
| 3,594,062 | A | 7/1971 | Disley |
| 3,669,523 | A | 6/1972 | Edwards |
| 4,044,399 | A | 8/1977 | Morton |
| 4,584,776 | A | 4/1986 | Shepherd |
| 4,601,540 | A | 7/1986 | Karning et al. |
| 4,605,281 | A | 8/1986 | Hellewell |
| 4,698,489 | A | 10/1987 | Hickin et al. |
| 4,758,719 | A | 7/1988 | Sasaki et al. |
| 4,786,966 | A | 11/1988 | Hanson et al. |
| 4,792,206 | A | 12/1988 | Skuratovsky |

(Continued)

FOREIGN PATENT DOCUMENTS

| | | |
|---|---|---|
| CN | 202057884 | 11/2011 |
| CN | 204730844 | 10/2015 |

(Continued)

OTHER PUBLICATIONS

Aebi, V. et al., "EBAPS: Next Generation, Low Power, Digital Night Vision", Presented at the OPTRO 2005 International Symposium, May 10, 2005, pp. 1-10, Paris, France, in 10 pages.

(Continued)

*Primary Examiner* — Joshua T Semick
(74) *Attorney, Agent, or Firm* — Knobbe, Martens, Oteon & Bear, LLP

(57) ABSTRACT

A digital sight for a weapon includes a sight body, a mount for a peripheral fixed to the sight body, and a controller. The controller is disposed in communication with a non-volatile memory and is responsive to instructions recorded to boresight a peripheral relative to the digital weapon sight. Weapon assemblies and methods of boresighting peripherals to digital weapon sights are also described.

19 Claims, 7 Drawing Sheets

(56) References Cited

U.S. PATENT DOCUMENTS 4,840,451 A 6/1989 Sampson et al.
5,005,213 A 4/1991 Hanson et al.
5,035,472 A 7/1991 Hansen
5,125,394 A 6/1992 Chatenever et al.
5,128,807 A 7/1992 Blackmon
5,140,151 A 8/1992 Weiner et al.
5,303,606 A 4/1994 Kokinda
5,359,675 A 10/1994 Siwoff
5,448,161 A 9/1995 Byerley, III et al.
5,463,495 A 10/1995 Murg
5,513,440 A 5/1996 Murg
5,535,053 A 7/1996 Baril et al.
5,584,137 A 12/1996 Teetzel
5,651,081 A 7/1997 Blew et al.
5,653,034 A 8/1997 Bindon
5,668,904 A 9/1997 Sutherland et al.
5,687,271 A 11/1997 Rabinowitz
5,711,104 A 1/1998 Schmitz
5,847,753 A 12/1998 Gabello et al.
5,903,996 A 5/1999 Morley
5,946,132 A 8/1999 Phillips
5,949,565 A 9/1999 Ishida
5,953,761 A 9/1999 Jurga et al.
5,956,444 A 9/1999 Duda et al.
6,020,994 A 2/2000 Cook
6,057,966 A 5/2000 Carroll et al.
6,069,656 A * 5/2000 Silver ..... G01S 17/89 348/169
6,200,041 B1 3/2001 Gaio et al.
6,272,692 B1 8/2001 Abraham
6,311,576 B1 11/2001 Pletschet
6,327,381 B1 12/2001 Rogina et al.
6,369,941 B2 4/2002 Zadravec
6,381,081 B1 4/2002 Ford
6,404,961 B1 6/2002 Bonja et al.
6,456,497 B1 9/2002 Palmer
6,519,890 B1 2/2003 Otterman
6,560,029 B1 5/2003 Dobbie et al.
6,574,053 B1 6/2003 Spinali
6,615,531 B1 9/2003 Holmberg
6,690,866 B2 2/2004 Bonja et al.
6,714,708 B2 3/2004 McAlpine et al.
6,807,742 B2 10/2004 Schick et al.
6,898,192 B2 5/2005 Chheda et al.
6,901,221 B1 5/2005 Jiang et al.
7,016,579 B2 3/2006 Militaru et al.
7,062,796 B1 6/2006 Dixon
D524,785 S 7/2006 Huang
7,069,685 B2 7/2006 Houde-Walter
7,096,512 B2 8/2006 Blair
7,128,475 B2 10/2006 Kesler
7,132,648 B2 11/2006 Ratiff et al.
7,166,812 B2 1/2007 White et al.
7,171,776 B2 2/2007 Staley, III
7,194,012 B2 3/2007 Mason et al.
7,210,262 B2 5/2007 Florence et al.
7,210,392 B2 5/2007 Greene et al.
7,219,370 B1 5/2007 Teetzel et al.
7,278,734 B2 10/2007 Jannard et al.
7,292,262 B2 11/2007 Towery et al.
7,298,941 B2 11/2007 Palen et al.
7,319,557 B2 1/2008 Tai
7,369,302 B2 5/2008 Gaber
7,409,792 B2 8/2008 Narcy et al.
7,437,848 B2 10/2008 Chang
7,462,035 B2 12/2008 Lee et al.
7,488,294 B2 2/2009 Torch
7,552,559 B2 6/2009 Day
7,609,467 B2 10/2009 Blanding et al.
7,612,956 B2 11/2009 Blanding et al.
7,627,975 B1 12/2009 Hines
7,649,550 B2 1/2010 Ishiyama et al.
7,676,137 B2 3/2010 Schick et al.
7,690,849 B2 4/2010 Scharf et al.
7,701,493 B2 4/2010 Mauritzson
7,705,855 B2 4/2010 Brown Elliott
7,710,654 B2 5/2010 Ashkenazi et al.
7,730,820 B2 6/2010 Vice et al.
7,740,499 B1 6/2010 Willey et al.
7,744,286 B2 6/2010 Lu et al.
7,787,012 B2 8/2010 Scales et al.
7,795,574 B2 9/2010 Kennedy et al.
7,800,852 B2 9/2010 Blanding et al.
7,827,723 B1 11/2010 Zaderey et al.
7,832,023 B2 11/2010 Crisco
7,842,922 B2 11/2010 Leneke et al.
7,899,332 B2 3/2011 Shindou et al.
7,911,687 B2 3/2011 Scholz
7,916,156 B2 3/2011 Brown Elliott et al.
7,933,464 B2 4/2011 Zhang et al.
7,952,059 B2 5/2011 Vitale et al.
7,972,067 B2 7/2011 Haley et al.
7,990,523 B2 * 8/2011 Schlierbach ..... F41G 3/065 356/5.01
8,014,679 B2 9/2011 Yamazaki
8,063,934 B2 11/2011 Donato
8,067,735 B2 11/2011 King et al.
8,082,688 B2 12/2011 Elpedes et al.
8,085,482 B2 12/2011 Frankovich et al.
8,093,992 B2 1/2012 Jancic et al.
8,112,185 B2 2/2012 Wu
8,153,975 B2 4/2012 Hollander et al.
8,225,542 B2 7/2012 Houde-Walter
8,253,105 B1 8/2012 Warnke et al.
8,312,667 B2 11/2012 Thomas et al.
8,336,776 B2 12/2012 Horvath et al.
8,337,036 B2 12/2012 Soto et al.
8,350,796 B2 1/2013 Tomizawa et al.
8,375,620 B2 2/2013 Staley, III
D677,298 S 3/2013 Hallgren
8,411,346 B2 4/2013 Sapir
8,488,969 B1 7/2013 Masarik
8,531,592 B2 9/2013 Teetzel et al.
8,532,490 B2 9/2013 Smith et al.
8,656,628 B2 2/2014 Jock et al.
8,717,392 B2 5/2014 Levola
8,773,766 B2 7/2014 Jannard et al.
8,776,422 B2 7/2014 Dodd et al.
8,781,273 B2 7/2014 Benjamin et al.
8,826,583 B2 * 9/2014 Kepler ..... G01B 11/272 42/119
8,849,379 B2 9/2014 Abreu
8,886,046 B2 11/2014 Masarik
8,908,045 B2 * 12/2014 Stewart ..... H04N 5/225 348/169
8,923,703 B2 12/2014 Masarik
8,928,878 B2 1/2015 Jaeschke et al.
8,942,632 B2 1/2015 Shen
9,042,736 B2 5/2015 Masarik
9,052,153 B2 6/2015 Oh et al.
9,057,583 B2 6/2015 Matthews et al.
9,069,001 B2 6/2015 Braman et al.
9,113,061 B1 * 8/2015 Morley ..... H04N 5/23293
9,225,419 B2 12/2015 Masarik
9,310,163 B2 4/2016 Bay
9,316,462 B2 * 4/2016 Varshneya ..... F41G 3/2616
9,319,143 B2 4/2016 El-Ahmadi et al.
9,335,122 B2 * 5/2016 Choiniere ..... F41G 1/54
9,372,051 B2 * 6/2016 Kepler ..... G01B 11/272
9,373,277 B2 6/2016 Sagan
9,389,677 B2 7/2016 Hobby et al.
9,429,391 B2 8/2016 Walker
9,438,774 B2 9/2016 Masarik
9,466,120 B2 * 10/2016 Maryfield ..... H01L 31/03046
9,506,725 B2 * 11/2016 Maryfield ..... F41G 3/06
9,516,202 B2 12/2016 Masarik et al.
9,615,004 B2 4/2017 Masarik
9,622,529 B2 4/2017 Teetzel et al.
9,658,423 B2 5/2017 Gustafson et al.
9,696,111 B2 7/2017 Saadon
9,705,605 B2 7/2017 Masarik
9,769,902 B1 * 9/2017 Cain ..... F41G 1/32
9,823,043 B2 11/2017 Compton et al.
9,861,263 B2 1/2018 Kwan et al.

(56) References Cited

U.S. PATENT DOCUMENTS

| | | | |
|---|---|---|---|
| 9,897,411 | B2 | 2/2018 | Compton et al. |
| 9,910,259 | B2 | 3/2018 | Armbruster et al. |
| 9,921,028 | B2 | 3/2018 | Compton et al. |
| 9,934,739 | B2 | 4/2018 | Hogan |
| 9,948,878 | B2 | 4/2018 | Simolon et al. |
| 9,995,901 | B2 | 6/2018 | Petersen |
| 10,003,756 | B2 | 6/2018 | Masarik et al. |
| 10,024,631 | B2 | 7/2018 | Portoghese et al. |
| 10,036,869 | B2 | 7/2018 | Fahr et al. |
| 10,095,089 | B2 | 10/2018 | Po et al. |
| 10,101,125 | B2 * | 10/2018 | Conklin ..... F41G 5/14 |
| 10,113,837 | B2 | 10/2018 | Masarik et al. |
| 10,190,848 | B2 | 1/2019 | VanBecelaere |
| 10,309,749 | B2 | 6/2019 | Hamilton |
| 10,379,135 | B2 | 8/2019 | Maryfield et al. |
| 2002/0027690 | A1 | 3/2002 | Bartur et al. |
| 2004/0031184 | A1 | 2/2004 | Hope |
| 2005/0232512 | A1 | 10/2005 | Luk et al. |
| 2005/0254126 | A1 | 11/2005 | Lin et al. |
| 2005/0268519 | A1 | 12/2005 | Pikielny |
| 2006/0165413 | A1 | 7/2006 | Schemmann et al. |
| 2007/0003562 | A1 | 1/2007 | Druilhe |
| 2007/0035626 | A1 | 2/2007 | Randall et al. |
| 2007/0213586 | A1 | 9/2007 | Hirose et al. |
| 2008/0263752 | A1 | 10/2008 | Solinsky et al. |
| 2008/0309586 | A1 | 12/2008 | Vitale |
| 2008/0317474 | A1 | 12/2008 | Wang et al. |
| 2009/0052023 | A1 | 2/2009 | Winker et al. |
| 2009/0181729 | A1 | 7/2009 | Griffin, Jr. et al. |
| 2010/0027943 | A1 | 2/2010 | Armani et al. |
| 2010/0149073 | A1 | 6/2010 | Chaum et al. |
| 2010/0225673 | A1 | 9/2010 | Miller et al. |
| 2010/0266245 | A1 | 10/2010 | Sabo |
| 2010/0308999 | A1 | 12/2010 | Chornenky |
| 2010/0328420 | A1 | 12/2010 | Roman |
| 2011/0041377 | A1 | 2/2011 | Thomas et al. |
| 2011/0067288 | A1 | 3/2011 | Hakansson et al. |
| 2011/0145981 | A1 | 6/2011 | Teetzel |
| 2011/0187563 | A1 | 8/2011 | Sanders-Reed |
| 2011/0213664 | A1 | 9/2011 | Osterhout et al. |
| 2011/0214082 | A1 | 9/2011 | Osterhout et al. |
| 2011/0239354 | A1 | 10/2011 | Celona et al. |
| 2012/0030985 | A1 | 2/2012 | Mauricio et al. |
| 2012/0033195 | A1 | 2/2012 | Tai |
| 2012/0097741 | A1 | 4/2012 | Karcher |
| 2012/0159833 | A1 | 6/2012 | Hakanson et al. |
| 2012/0182417 | A1 | 7/2012 | Everett |
| 2012/0182610 | A1 | 7/2012 | O'Hara et al. |
| 2012/0192476 | A1 | 8/2012 | Compton et al. |
| 2012/0212414 | A1 | 8/2012 | Osterhout et al. |
| 2012/0238208 | A1 | 9/2012 | Bienas et al. |
| 2012/0255213 | A1 | 10/2012 | Panos |
| 2012/0311910 | A1 | 12/2012 | Mironichev et al. |
| 2012/0317706 | A1 | 12/2012 | Lebel et al. |
| 2012/0320340 | A1 | 12/2012 | Coleman, III |
| 2012/0327247 | A1 | 12/2012 | Mironichev et al. |
| 2013/0016215 | A1 | 1/2013 | Bitar et al. |
| 2013/0033746 | A1 | 2/2013 | Brumfield |
| 2013/0036646 | A1 | 2/2013 | Rubac et al. |
| 2013/0072120 | A1 | 3/2013 | Wu |
| 2013/0088604 | A1 | 4/2013 | Hamrelius et al. |
| 2013/0167425 | A1 | 7/2013 | Crispin |
| 2013/0188943 | A1 | 7/2013 | Wu |
| 2013/0215395 | A1 | 8/2013 | Li |
| 2014/0007485 | A1 | 1/2014 | Castejon, Sr. |
| 2014/0104449 | A1 | 4/2014 | Masarik et al. |
| 2014/0260748 | A1 | 9/2014 | Traver |
| 2015/0101234 | A1 | 4/2015 | Priest et al. |
| 2015/0226613 | A1 | 8/2015 | Bauer et al. |
| 2015/0282549 | A1 | 10/2015 | Lebel et al. |
| 2015/0316351 | A1 | 11/2015 | Choiniere |
| 2016/0033234 | A1 | 2/2016 | Swift et al. |
| 2016/0327365 | A1 | 11/2016 | Collin et al. |
| 2017/0010073 | A1 | 1/2017 | Downing |
| 2017/0078022 | A1 | 3/2017 | Masarik et al. |
| 2017/0122706 | A1 | 5/2017 | Masarik et al. |
| 2017/0153713 | A1 | 6/2017 | Niinuma et al. |
| 2017/0237919 | A1 | 8/2017 | Lamesch |
| 2017/0302386 | A1 | 10/2017 | Masarik |
| 2018/0232952 | A1 | 8/2018 | Hiranandani et al. |
| 2018/0246135 | A1 | 8/2018 | Pan et al. |
| 2018/0302576 | A1 | 10/2018 | Masarik et al. |
| 2018/0364272 | A1 * | 12/2018 | Maryfield ..... G01P 5/26 |
| 2019/0033039 | A1 | 1/2019 | Masarik et al. |
| 2019/0094981 | A1 | 3/2019 | Bradski et al. |
| 2019/0166174 | A1 | 5/2019 | Moseman |
| 2019/0353461 | A1 | 11/2019 | Neal et al. |
| 2019/0353462 | A1 | 11/2019 | Neal |

FOREIGN PATENT DOCUMENTS

| | | |
|---|---|---|
| CN | 204944509 | 1/2016 |
| EP | 0 176 169 | 4/1986 |
| EP | 2 722 632 | 4/2014 |
| EP | 2 812 749 | 12/2014 |
| EP | 3 172 524 | 5/2017 |
| EP | 3 205 974 | 8/2017 |
| EP | 3 239 754 | 11/2017 |
| GB | 2162654 | 2/1986 |
| JP | H07-295682 | 11/1995 |
| WO | WO 2005/121688 | 12/2005 |
| WO | WO 2013/080058 | 6/2013 |
| WO | WO 2013/102869 | 7/2013 |
| WO | WO 2013/119983 | 8/2013 |
| WO | WO 2014/062725 | 4/2014 |
| WO | WO 2014/150076 | 9/2014 |
| WO | WO 2016/014655 | 1/2016 |
| WO | WO 2019/222422 | 11/2019 |
| WO | WO 2019/222426 | 11/2019 |

OTHER PUBLICATIONS

Ackerman, S., "It Only Took the Army 16 Years and 2 Wars to Deploy this Network", Wired.com, Jun. 28, 2012, in 7 pages. URL: http://www.wired.com/dangerrom/2012/06/army-data-network-war/all/.

Armstrong, S. C., "Project Manager Soldier Weapons Program Overview NDIA", May 15, 2012, in 38 pages.

Schott—Glass Made of Ideas, GBPS-MC-GOF-Demo, dated Jan. 2006, pp. S.1-S.8, in 8 pages.

Sklarek, W., High Data Rate Capabilities of Multicore Glass Optical Fiber Cables, 22 FGT "Otische Polymerfasern", dated Oct. 25, 2006, in 19 pages. URL: http://www.pofac.de/downloads/itgfg/fgt2.2/FGT2.2_Munchen_Sklarek_GOF-Buendel.

Tao, R. et al., "10 Gb/s CMOS Limiting Amplifier for Optical links", Proceedings of the 29th European Solid-State Circuits Conference, Sep. 16-18, 2013, pp. 285-287, Estoril, Portugal, in 3 pages.

U.S. Appl. No. 13/674,895, filed Nov. 12, 2012, titled Intrapersonal Data Communication System, listing David Michael Masarik as an inventor, in 95 pages, and its entire prosecution history.

* cited by examiner

BORESIGHTING PERIPHERALS TO DIGITAL WEAPON SIGHTS

BACKGROUND OF THE INVENTION

1. Field of the Invention

The present disclosure relates to digital weapon sights, and more particularly to boresighting peripherals to digital weapon sights in weapon assemblies.

2. Description of Related Art

Firearms commonly include sights for aiming. The sight provides the shooter with a sight picture representative of where a projectile fired from the firearm will strike. The sight accuracy of the sight picture provided by the sight typically corresponds to the alignment of the sight with the firearm arm bore. The alignment is generally the product of a boresighting process and subsequent zeroing process. Boresighting typically entails a coarse mechanical adjustment to the sight/bore alignment that places the trajectory of a projectile fired from a firearm within the sight picture provided by the site a predetermined distance. Zeroing generally entails a fine mechanical adjustment that places the trajectory in the center of the sight picture at the predetermined distance to account for quirks of the shooter and/or the specific firearm.

Some firearms include modular sights. Modular sights allow for attachment of additional devices to the sight. Due to manufacturing variation in the modular sight and/or device attached to the module sight each device attached to a modular sight can have a different misalignment relative to the firearm bore. It can therefore be necessary to boresight devices attached to a modular sight, typically by mechanically adjusting the alignment of device relative to the sight.

Such conventional methods and systems have generally been considered satisfactory for their intended purpose. However, there is still a need in the art for improved digital weapon sights, firearm assemblies having digital weapon sights, and methods of boresighting peripherals to digital weapon sights. The present disclosure provides a solution for this need.

SUMMARY OF THE INVENTION

A digital sight for a weapon includes a sight body having a mount, an image sensor fixed relative to the mount, and a controller. The controller is operatively connected to the image sensor, is disposed in communication with a memory, and is responsive to instructions recorded on the memory to boresight a peripheral relative to the digital weapon sight.

In certain embodiments a display can be fixed relative to the mount. The controller can be operatively connected to the display. The digital weapon sight can have an data connector. The controller can be disposed in communication with the data connector to receive sensor data from the peripheral. The memory can include a non-volatile memory. The non-volatile memory can have recorded on it a mount offset for boresighting the mount to the image sensor. The mount offset can be a differential between pointing of the mount and pointing of the image sensor relative to a reference digital weapon sight.

In accordance with certain embodiments a peripheral removably fixed to the mount. The peripheral can include a sensor. The sensor can be disposed in communication with the controller. The sensor can have a field of view overlapping a field of view of the image sensor. The sensor can have a pointing that is offset relative to pointing of the image sensor. The peripheral can have a non-volatile memory. The non-volatile memory can be disposed in communication with the digital weapon sight controller. The non-volatile memory can have a peripheral offset recorded on it for boresighting the peripheral relative to a digital weapon sight. The peripheral offset can be a differential between pointing of the sensor relative to pointing of a reference sensor. The peripheral can include a controller operatively connected to the sensor. It is contemplated that the peripheral can include an data connector disposed in communication with both the digital weapon sight controller and the peripheral controller.

It is also contemplated that, in accordance with certain embodiments, that the instructions can cause the controller to receive the mount offset from the digital weapon sight memory. The instructions can cause the controller to receive the peripheral offset from the peripheral. The instructions can cause the controller to boresight the peripheral to the digital weapon sight by adding the mount offset to the peripheral offset. The instructions can cause the controller to shift data received from the peripheral sensor relative to image data received from the image sensor by the boresight, such as for display on a display of the digital weapon sight. The peripheral can include a digital camera and/or a laser range finder by way of non-limiting example.

A weapon assembly includes a weapon and the digital weapon sight as described above. The digital weapon sight is removably fixed to the weapon. A peripheral with a sensor is removably fixed to the digital weapon sight mount, the sensor boresighted to the image sensor without mechanically adjusting of the peripheral once removably fixed to the mount.

A method of boresighting a peripheral to a digital weapon sight includes, at a digital weapon sight as described above, removably fixing a peripheral to the mount. Upon removable fixation of the peripheral the digital weapon sight controller boresights the peripheral relative to the digital weapon sight.

In certain embodiments boresighting can include receiving a mount offset stored in a digital weapon sight non-volatile memory. The mount offset can be determined by measuring difference between pointing of the mount and pointing of mount on a reference digital weapon sight and storing the difference between pointing of the mount and pointing of mount on a reference digital weapon sight as the mount offset in the memory of the digital weapon sight.

In accordance with certain embodiments, boresighting the peripheral to the image sensor can include receiving a peripheral offset from the peripheral. The peripheral offset can be determined by measuring difference between pointing of the peripheral and pointing of reference peripheral and storing the difference between pointing of the peripheral and pointing of reference peripheral as a peripheral in the memory of the peripheral.

It is contemplated that the mount offset can be received from the digital weapon sight memory, the peripheral offset can be received from the peripheral, and the boresight between the peripheral and the digital weapon sight determined by weapon sight by adding the mount offset to the peripheral offset. Data received from the peripheral sensor can be shifted relative to image data received from the image sensor by the boresight, such as for common display in the digital weapon sight display.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION OF THE PREFERRED EMBODIMENTS

Figure 1:
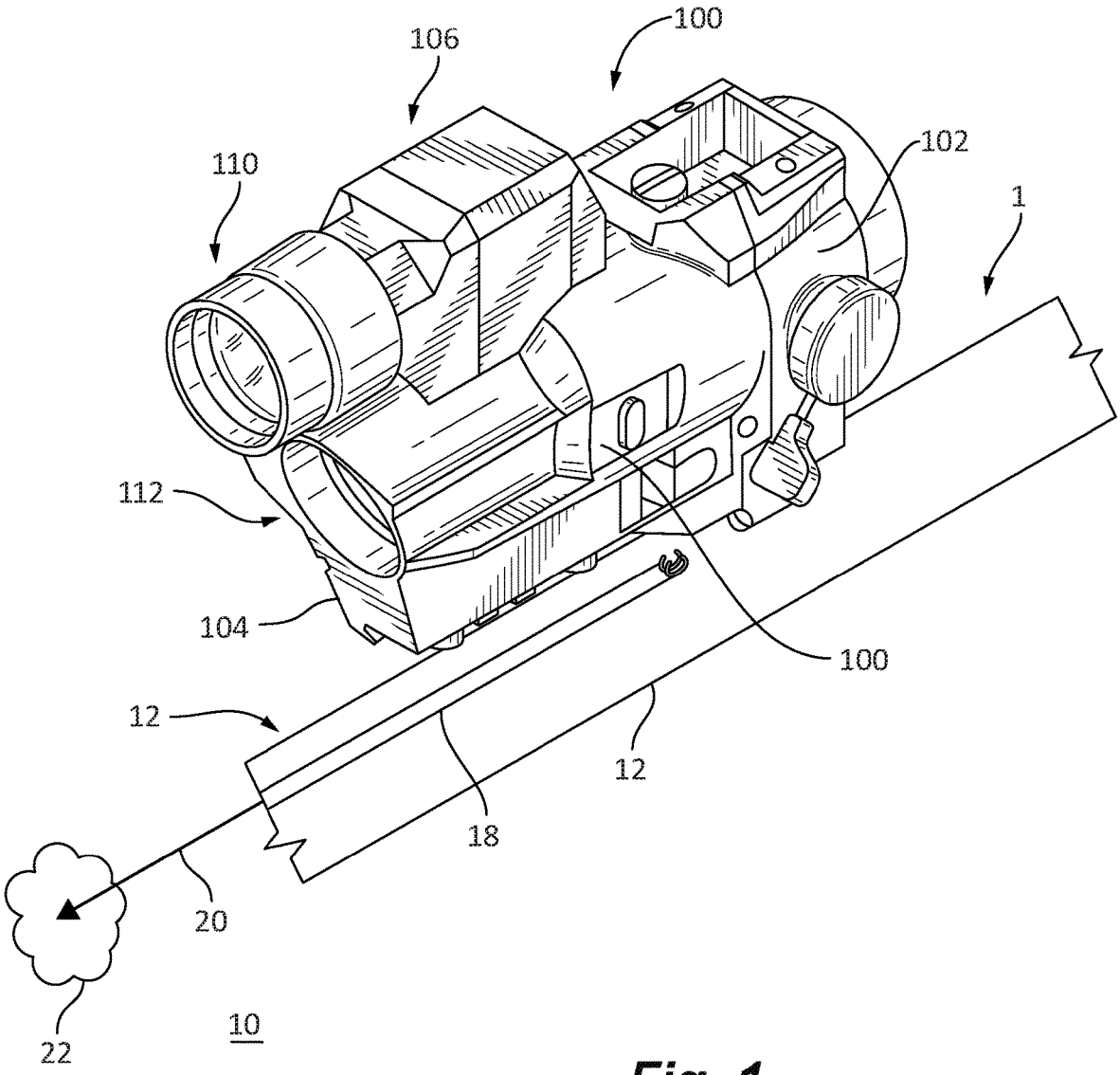
FIG. 1 is a perspective view of an exemplary embodiment of a weapon assembly constructed in accordance with the present disclosure, showing a digital weapon sight with a peripheral removably fixed to the digital weapon sight.

Reference will now be made to the drawings wherein like reference numerals identify similar structural features or aspects of the subject disclosure. For purposes of explanation and illustration, and not limitation, a partial view of an exemplary embodiment of a digital weapon sight in accordance with the disclosure is shown in FIG. 1 and is designated generally by reference character 100. Other embodiments of digital weapon sights, weapon assemblies having digital weapon sight, and methods of boresighting peripherals to digital weapon sights in accordance with the disclosure, or aspects thereof, are provided in FIGS. 2-9, as will be described. The systems and methods described herein can be used to automatically boresight peripherals to digital weapon sights, such as in weapon assemblies for military applications, though the present disclosure is not limited to military applications or to weapon assemblies in general.

Referring to FIG. 1, a weapon assembly 10 is shown. Weapon assembly 10 includes a weapon 12 and digital weapon sight 100. Weapon 12 has a muzzle end 14, a receiver end 16 opposite muzzle end 14, and a bore 18 extending at least partially between receiver end 16 and muzzle end 14. Bore 18 defines an axis 20, which extends axially in the direction of a scene 22. Digital weapon sight 100 is removably fixed weapon 12 between muzzle end 14 and receiver end 16 of weapon 12 and has a sight body 102 with one or more mount 104 for removably fixation of a peripheral, e.g., a peripheral 106. For example, digital weapon sight 100 can be removably fixed to iron sights affixed to weapon 12.

Peripheral 106 has mechanical connection 108 (shown in FIG. 3) for removably fixing peripheral 106 to mount 104 and a sensor 110. Sensor 110 is supported within peripheral 106 and configured for data communication with digital weapon sight 100 through a data connector 112 (shown in FIG. 3). In certain embodiments sensor 110 includes a camera or a laser range finder. In accordance with certain embodiments imaging sensor 112 includes an imaging device, such as in infrared or an infrared sub-band camera. It is contemplated that digital weapon sight 100 can be a modular weapon sight arranged to allow for removable fixation of peripherals configured for providing different types of data to digital weapon sight 100. Digital weapon sight 100 can be as described in U.S. Patent Application Publication No. 2017/0122706 A1, filed on Nov. 2, 2016, the contents of which are incorporated herein by reference in their entirety. Examples of suitable digital weapon sights Examples of suitable digital weapon sights include MDOG® and MADOG® digital weapon sights, available from N2 Imaging Systems, LLC. of Irvine, Calif.

Figure 2:
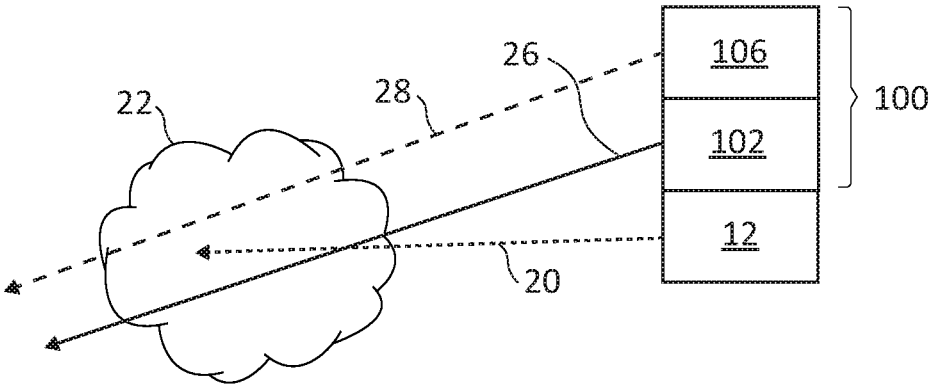
FIG. 2 is a schematic view of the digital weapon sight and peripheral of FIG. 1, showing a sensor supported in the peripheral and an imaging sensor supported in a sight body of the digital weapon sight.

With reference to FIG. 2, a pointing differential 24 exists between peripheral 106 and sight body 102 of digital weapon sight 100. As shown in FIG. 2, sight body 102 has a pointing 26 which is angled relative to bore axis 20 of weapon 12. Peripheral 106 has a pointing 28 which is also angled relative to bore axis 20 of weapon 12. Pointing 28 of sight body 28 is angled relative to both bore axis 20 and pointing 26 of sight body 102. The magnitude of difference between the pointing 28 of peripheral 106 and pointing of sight body 26 is a function of, among other things, variation between mount 104 and a reference sight body and variation between peripheral 106 and a reference peripheral 106.

Figure 3:
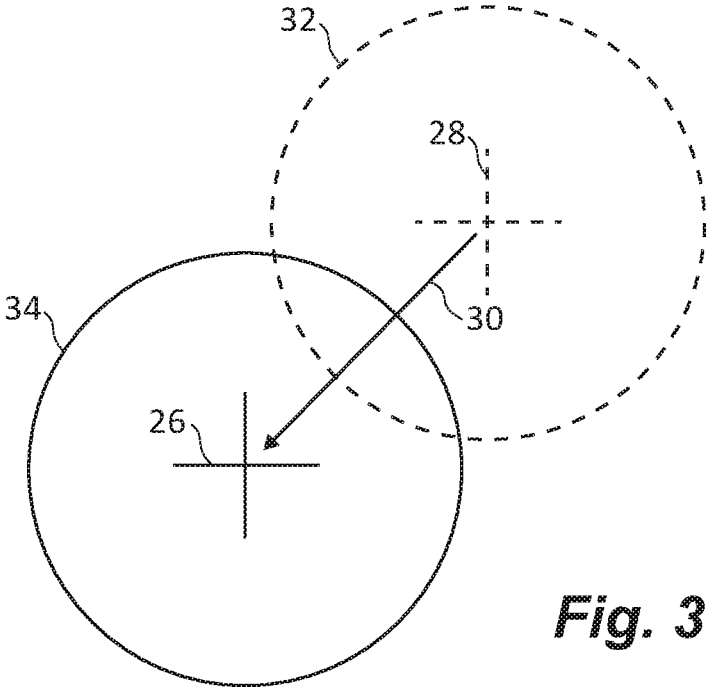
FIGS. 3 and 5 are schematic views of the digital weapon sight of FIG. 1, showing the peripheral prior to boresighting to the sight body and after boresighting the peripheral to the sight body, position of the peripheral being unchanged by the boresighting.

As shown in FIG. 3, the difference between pointing 28 of peripheral 106 and pointing 26 of sight body 102 introduces a boresight differential 30 between the field of view of the peripheral 106 and sight body 102, the magnitude of boresight differential 30 typically varying according the piece parts making up a particular sight body/peripheral matchup. As will be appreciated by those of skill in the art in view of the present disclosure, the magnitude of boresight differential 30 can, in some digital sights, require a mechanical adjustment of the pointing of the peripheral relative to the sight body for data collected by each to fully utilized by a user. As will also be appreciated by those of skill in the art in view of the present disclosure, such mechanical adjustments can be time consuming and/or present a source of error to user in setting up a weapon assembly.

Figure 4:
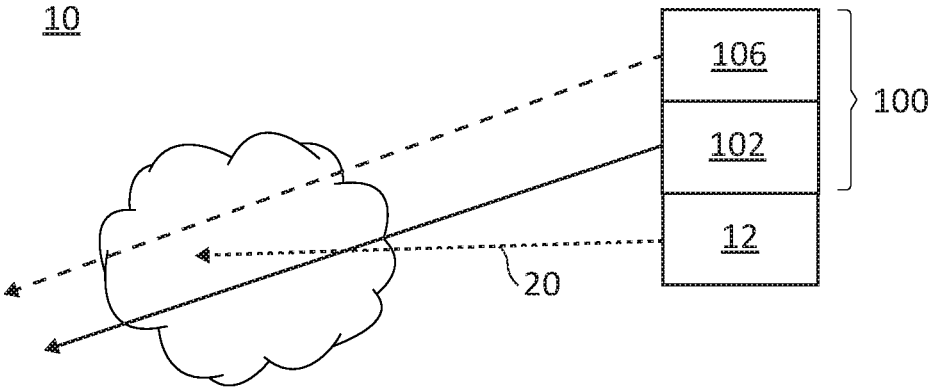
FIGS. 4 and 6 are schematic views of the field of view of the peripheral and the sight body, showing change in placement of the peripheral field of view relative to the sight body field of view as a result of boresighting the peripheral to the sight body.
Figure 5:
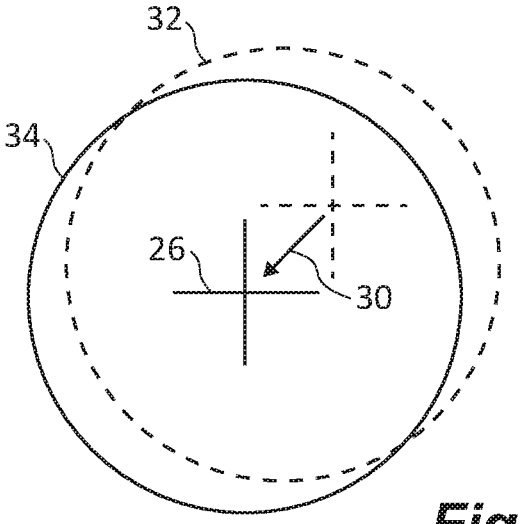

Referring to FIGS. 4 and 5, digital weapon sight 100 is shown with a 'soft' boresight. The boresight causes field of view 32 of peripheral 106 to more closely correspond (overlap) with field of view 34 of sight body 102, as shown in FIG. 5, without mechanically adjusting position of peripheral 106, as shown with the correspondence of FIG. 4 and FIG. 2. In this respect digital weapon sight 100 includes sight body 102 with mount 104, an image sensor 114 fixed relative to mount 104, and a controller 116. Controller 116 is operatively connected to image sensor 114 and is in communication with a memory 118 and is responsive to instructions recorded on memory 118 to boresight a peripheral, e.g., peripheral 106, relative to sight body 102.

Figure 6:
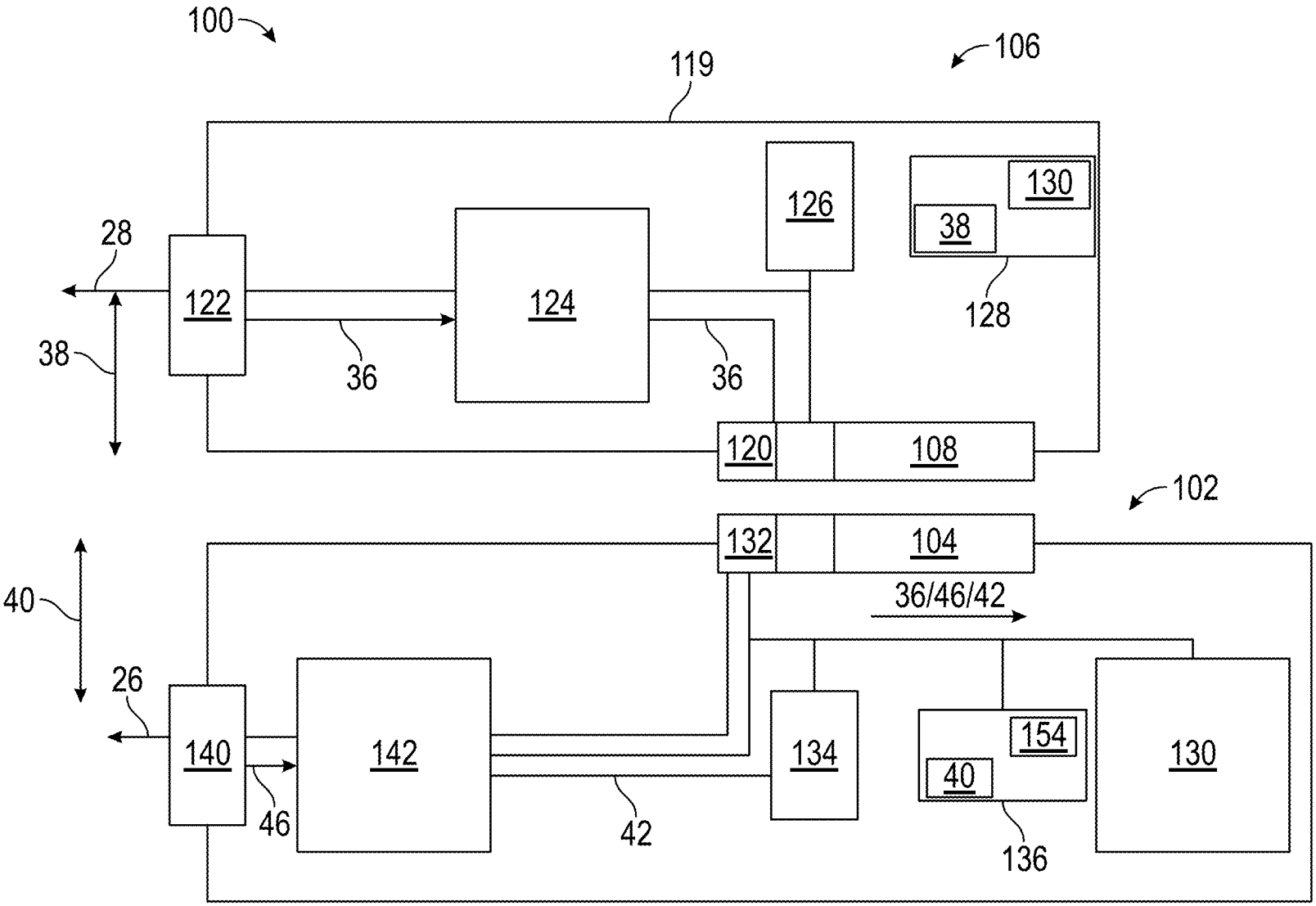

With reference to FIG. 6, peripheral 106 and sight body 102 of digital weapon sight 100 are shown. Digital weapon sight 100 includes sight body 102 with mount 104 and peripheral 106. Peripheral 106 includes a peripheral body 119 with mechanical connection 108 and an adjacent data connector 120, a sensor 122, and sensor processing module 124. Mechanical connection 108 is configured for removably fixing peripheral 106 to sight body 102 at mount 104. Data connector 120 is configured for providing data communication between peripheral 106 and sight body 106, and can include a pogo pad-type connector for electrical communication or a wireless link.

Sensor 122 is disposed in communication with sensor processing module 124, and is arranged to provide sensor data 36 acquired from field of view 32 (shown in FIG. 3) to sensor processing module 124. Sensor processing module 124 is disposed in communication with data connector 120 and is configured to route sensor data 36 to sight body 102 via data connector 120. In certain embodiments sensor 122 includes a camera. The camera can be a visible light camera, an infrared camera, or an infrared sub-band camera such as a near infrared (NIR) sub-band or a short-wave infrared (SWIR) sub-band camera, sensor data 36 including image data acquired using light incident upon sensor 122 within the visible waveband, infrared waveband, or infrared sub-band. In accordance with certain embodiments sensor 122 can include a laser range finder, sensor data 36 including range data. It is also contemplated that sensor 122 can include an illuminator, such as visible light illuminator, infrared illuminator, or infrared sub-band illuminator.

Peripheral 106 includes a controller 126 and a non-volatile memory 128. Controller 126 is disposed in communication with non-volatile memory 128 and sensor processing block 124 for operative connection therethrough of sensor 122. Non-volatile memory 128 includes a non-transitory medium having a peripheral offset 38 and a plurality of program modules 130 with instructions recorded on it that, when read by controller 126, cause controller 126 to execute certain actions. For example, the instructions can cause controller 126 to communicate with controller 116 via data connector 120, push peripheral offset 38 stored on non-volatile memory 128, and cause sensor 122 to acquire sensor data 36. As will be appreciated by those of skill in the art in view of the present disclosure, use of non-volatile memory 128 to retain peripheral offset enables the mount offset to be retained within and travel with sight body 102 following a commissioning calibration and without thereafter requiring power from a battery to retain peripheral offset 38.

Sight body 102 has mount 104 and an adjacent data connector 132, a controller 134, a non-volatile memory 136, and a display 138. Mount 104 is configured to receive mechanical connection 108 of peripheral 106 for removably fixing peripheral 106 to sight body 102. Data connector 132 is configured for data communication with peripheral 106 through data connector 112 of peripheral 106, and can include a pogo pad-type connector or a wireless link.

Controller 134 is disposed in communication with data connector 132 for receiving therethrough sensor data 34 and peripheral offset 38 from peripheral 106. Controller 134 is also disposed in communication with non-volatile memory 136 for receiving therefrom a mount offset 40. Controller 134 is additionally disposed in communication with display 138, which is fixed relative to sight body 102, for operative connection to display 138 for displaying to a user an image 44 including scene 22.

Figure 7:
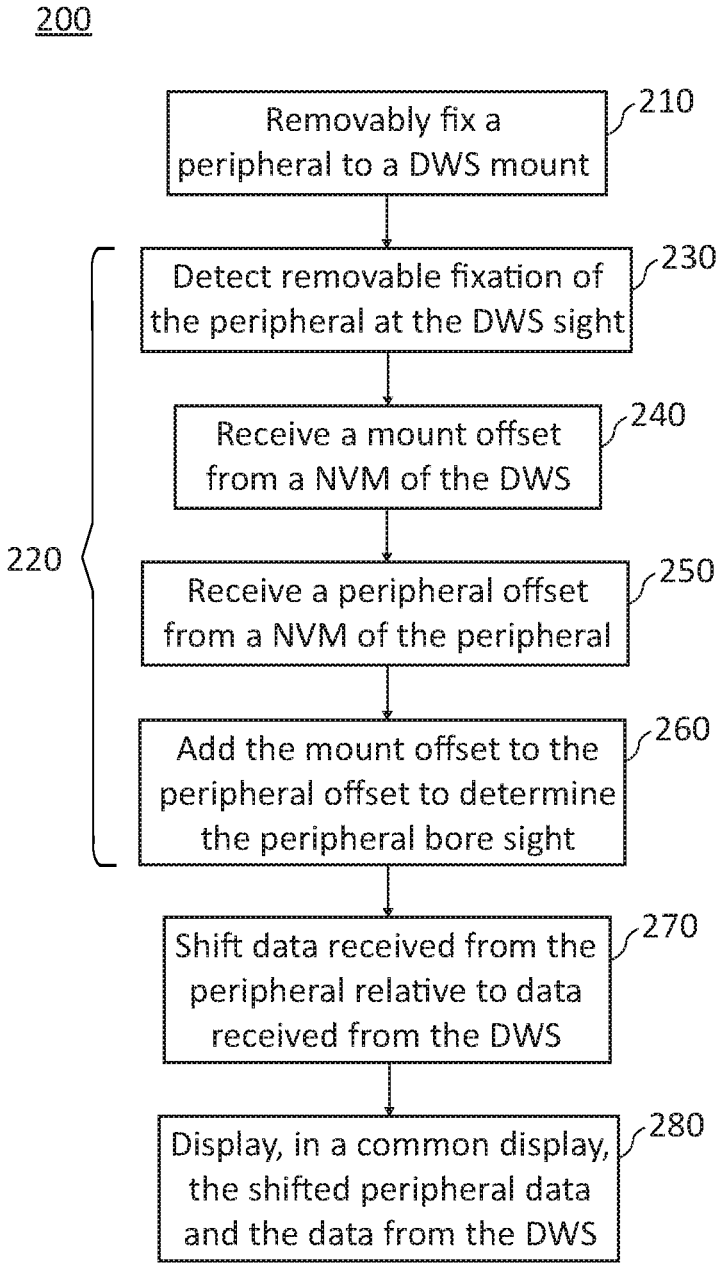
FIGS. 7-9 are block diagram of a method of boresighting a peripheral to a sight body, showing operations of the boresighting method and operations for establishing peripheral and mount offsets, respectively.

Non-volatile memory 136 has a plurality of program module 152 recorded on it that, when read by controller 134, cause controller 134 to execute operations to boresight peripheral 106 to sight body 102, e.g., method 200 (shown in FIG. 7). In this respect, based on mount offset 40 and peripheral offset 38, controller 134 determines a boresight 42 of peripheral 106 relative to sight body 102. Boresight 42 is applied to sensor data 36 to reduce (or eliminate entirely) boresight differential 30. In certain embodiments boresight 42 includes at least one of an x-shift and a y-shift which re-identifies a pixel value with sensor data 34 as the center pixel for purposes of associating a pixel matrix to an image 44 presented to a user on display 138. As will be appreciated by those of skill in the art in view of the present disclosure, use of a non-volatile memory to retain mount offset 40 also enables the mount offset to be retained following a commissioning process within and travel with sight body 102 without thereafter requiring power from a battery.

As shown in FIG. 6 digital weapon sight 100 also includes an imaging sensor 140 and an image sensor processing module 142. Imaging sensor 140 is configured for acquiring image data 46 of scene 22 from field of view 34 of sight body 102. Image sensor processing module 142 is disposed in communication with imaging sensor 140 for processing image data 46 and manipulating image data 46 for display as image 44 on display 138. Controller 134 is disposed in communication with image sensor processing module 142 and imaging sensor 140 for operative connection of imaging sensor 140. Imaging sensor 140 can be, for example, a camera such as visible light camera, an infrared waveband camera, or an infrared sub-band camera like a NIR or a SWIR sub-band camera.

With reference to FIG. 7, method 200 of boresighting a peripheral to a digital weapon sight is shown. Method 200 includes removably fixing a peripheral, e.g., peripheral 106 (shown in FIG. 1) to a mount of a digital weapon sight, e.g., mount 104 (shown in shown in FIG. 1), as shown with box 210. Upon removable fixation of the peripheral the mount of the digital weapon sight a controller of the digital weapon sight, e.g., controller 116 (shown in FIG. 6), boresights the peripheral relative to a sight body, e.g., sight body 102 (shown in FIG. 1), of digital weapon sight, as shown with bracket 220.

Method 200 also includes detecting removable fixation of the peripheral in the digital weapon sight, as show with box 230. In this respect establishing an electrical connection or wireless link between of a data connector of the peripheral and a data connector of the sight body, e.g., data connector 112 (shown in FIG. 6) and data connector 132 (shown in FIG. 6) In certain embodiments the controller boresights the peripheral to the digital weapon sight automatically. It is contemplated that the boresighting require no mechanical adjustment to position of the peripheral relative to the sight body. It is also contemplated that boresighting require no user intervention once the peripheral is received and removably fixed in the mount.

Upon removable fixation of the peripheral to the mount offsets are received by the controller for boresighting the peripheral to the sight body, as shown with box 240 and box 250. As shown with box 250, a peripheral offset, e.g. peripheral offset 38, is received from a non-volatile memory of the peripheral, e.g., non-volatile memory 128 (shown in FIG. 6). As shown with box 240, a mount offset, e.g. mount offset 40, is received from a non-volatile memory of the sight body of the digital weapon sight, e.g., non-volatile memory 136 (shown in FIG. 6). It is contemplated that the peripheral offset be a piece-part specific peripheral offset, such as a peripheral offset established using a peripheral offset calibration method, e.g., peripheral calibration method 300 (shown in FIG. 8). It is also contemplated that the mount offset be a piece-part specific mount offset, such as established using a sight body mount offset calibration method, e.g., sight body mount calibration method 400 (shown in FIG. 9). In certain embodiments the mount offset is selected from a plurality of mount offsets stored on the site body non-volatile memory, such as according to location on the sight body of the specific data connector through which the controller establishes communication with the peripheral.

Once the controller receives the peripheral offset and the mount offset controller determines the boresight for the specific peripheral/sight body matchup. In this respect, as shown with box 260, controller adds the peripheral offset to the mount offset associated with the mount to which the peripheral is removably fixed to determine the peripheral boresight. The peripheral boresight can include a x-shift. The peripheral boresight can include a y-shift.

Based on the boresight the controller shifts data presented on a display of the digital weapon sight, e.g., display 138 (shown in FIG. 6), as shown with box 270 and box 280. For example, a default center pixel assignment in image data acquired by the digital weapon sight in a pixel value array, e.g., image data 46 (shown in FIG. 6), can be reassigned for generation of an image presented to the user on the common display of the digital weapon sight, e.g., image 44 (shown in FIG. 6), as shown in box 280. This can be done, for example, by shifting the pixel assignment by distances corresponding to the x-shift and the y-shift of the boresight. Similarly, the pixel assignment of sensor data, e.g., sensor data 36 (shown in FIG. 6), can also be shifted by the x-shift and the y-shift of the calculated boresight.

Figure 8:
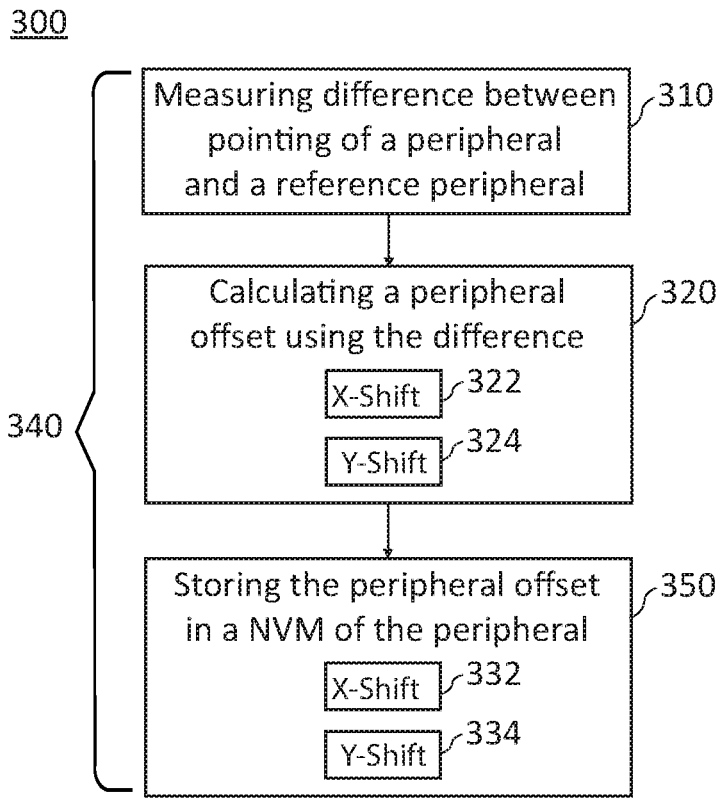

With reference to FIG. 8, a method 300 of calibrating a peripheral for a digital weapon sight, e.g., peripheral 106 (shown in FIG. 6), is shown. As shown in box 310, method 300 includes measuring difference between pointing of the peripheral and a reference peripheral, for example, by measuring pointing difference between a mechanical connection, e.g., mechanical connection 108 (shown in FIG. 6) fixed relative to the peripheral and a mechanical connection fixed relative to reference peripheral. A difference is calculated between pointing of the peripheral and the reference peripheral and associated with peripheral as a peripheral offset in association with the peripheral as a piece part, e.g., peripheral offset 38 (shown in FIG. 6), as shown with box 320. The peripheral offset is then stored in a non-volatile memory of the peripheral, e.g., non-volatile memory 128 (shown in FIG. 6), as shown with box 330. The peripheral offset can include an x-shift and a y-shift, as shown with boxes 322, 324, 332, and 334. It is contemplated that the method 300 be done for a set of interchangeable peripherals using a 'golden peripheral' as the reference peripheral, as shown with bracket 340.

Figure 9:
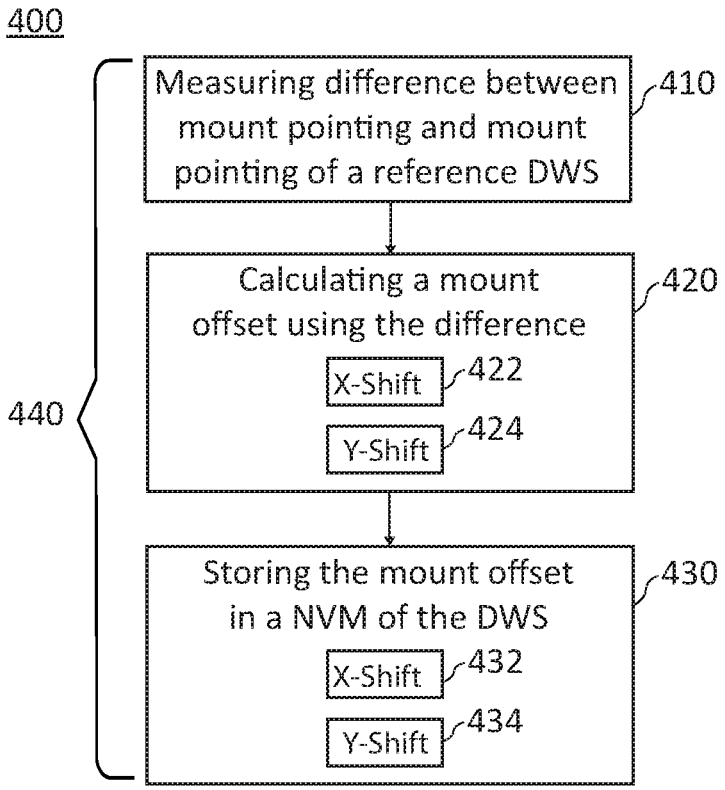

With reference to FIG. 9, a method 400 of calibrating a sight body of a digital weapon sight, e.g., sight body 102 (shown in FIG. 1). As shown in box 410, method 400 includes measuring difference between pointing of a mount on sight body and a mount on a reference sight body, for example, by measuring pointing difference between a mount, e.g., mount 104 (shown in FIG. 1) fixed relative to the sight body and a corresponding mount fixed relative to reference peripheral. A difference is calculated between pointing of the mount and the corresponding mount on the reference sight body, and the difference associated with sight body and mount as a piece part, e.g., mount offset 40 (shown in FIG. 6), as shown with box 420. The mount offset is then stored in a non-volatile memory of the sight body, e.g., non-volatile memory 154 (shown in FIG. 6), as shown with box 430. The mount offset can include an x-shift and a q-shift, as shown with boxes 422, 424, 432, and 434. It is contemplated that the method 400 be done for one or more mounts fixed relative to given sight body and/or for mounts of a set of digital sight bodies using a 'golden sight body' as the reference peripheral, as shown with bracket 440.

In conventional digital modular weapon sight systems periphery modules typically lack boresighting when connected to the weapon sight. In certain embodiments described herein peripheral modules to a digital weapon sight are auto boresighted to the digital weapon sight. In accordance with certain embodiments peripheral modules are auto boresighted to the digital weapon sight by storing and recalling calibration data stored in the peripheral module. It is also contemplated that peripheral modules can be auto boresighted to the digital weapon sight by storing and recalling calibration data from the digital weapon sight. As will be appreciated by those of skill in the art in view of the present disclosure, certain embodiments described herein peripheral modules can be swapped between two or more locations on a digital weapon sight and retain boresighting to the digital weapon and/or the weapon to which the digital weapon sight is removably attached.

The methods and systems of the present disclosure, as described above and shown in the drawings, provide for boresighting of peripheral module to digital weapon site system with superior properties including storing and recalling calibration data held at least one of the digital weapon sight and the peripheral module. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A digital sight for a weapon, comprising:

a sight body;

a mount for a peripheral fixed to the sight body; and a controller disposed in communication with a non-volatile memory, wherein the controller is responsive to instructions recorded on the memory to boresight a peripheral relative to the digital sight using a mount offset associated with the mount and recorded on the non-volatile memory.

2. The digital sight as recited in claim 1, further comprising a display fixed relative to the mount, the controller operatively connected to the display.

3. The digital sight as recited in claim 1, further comprising a data connector, the controller in communication with the data connector to receive sensor data from the peripheral.

4. The digital sight as recited in claim 1, wherein the non-volatile memory has recorded on it a mount offset for boresighting the mount to an image sensor.

5. The digital sight as recited in claim 4, wherein the mount offset is a differential between pointing of the mount and the image sensor relative to a reference digital sight.

6. The digital sight as recited in claim 1, further comprising a peripheral removably fixed to the mount.

7. The digital sight as recited in claim 6, wherein the peripheral includes a sensor disposed in communication with the controller, the sensor having a field of view overlapping a field of view of an image sensor, the sensor having pointing offset relative to image sensor pointing.

8. The digital sight as recited in claim 6, wherein the peripheral includes a non-volatile memory having a peripheral offset recorded on it for boresighting the peripheral relative to a digital sight, the non-volatile memory disposed in communication with the controller.

9. The digital sight as recited in claim 8, wherein the peripheral offset is a differential between pointing of a sensor relative to pointing of a reference sensor.

10. The digital sight as recited in claim 6, wherein the instructions cause the controller to:

receive the mount offset from the digital sight memory;

receive a peripheral offset from the peripheral;

boresight the peripheral to the digital sight by adding the mount offset to the peripheral offset; and shift data received from a peripheral sensor relative to image data received from an image sensor by the boresight for display on a display of the digital sight.

11. The digital sight as recited in claim 6, wherein the peripheral comprises:

a peripheral controller operatively connected to a sensor; and a data connector in communication with the digital sight controller and the peripheral controller.

12. The digital sight as recited in claim 6, wherein the peripheral includes a digital camera or a laser range finder.

13. A weapon assembly, comprising:

a weapon with a digital weapon sight as recited in claim 1 fixed to the weapon; and a peripheral with a sensor removably fixed to the digital sight mount and boresighted to the sensor of the digital sight, wherein the sensor is boresighted to the image sensor without mechanically adjusting the peripheral once removably fixed to the mount.

14. A method of boresighting a peripheral to a digital sight, comprising:

at a digital weapon sight including a sight body, a mount fixed relative to the sight body, and a controller disposed in communication with a non-volatile memory, removably fixing a peripheral to the mount; and boresighting the peripheral relative to the sight body upon removable fixation of the peripheral to the mount, wherein boresighting includes receiving a mount offset stored in the digital weapon sight non-volatile memory.

15. The method as recited in claim 14, further comprising:

measuring a difference between pointing of the mount and pointing of the mount on a reference digital weapon sight; and storing the difference between pointing of the mount and pointing of the mount on the reference digital weapon sight as a mount offset in the non-volatile memory of the digital weapon sight.

16. The method as recited in claim 14, wherein boresighting the peripheral includes receiving a peripheral offset from the peripheral.

17. The method as recited in claim 16, further comprising:

measuring a difference between pointing of the peripheral and pointing of reference peripheral; and storing the difference between pointing of the peripheral and pointing of reference peripheral as a peripheral in a memory of the peripheral.

18. The method as recited in claim 14, further comprising:

receiving a mount offset from the digital weapon sight memory;

receiving a peripheral offset from the peripheral, wherein boresighting the peripheral to the digital weapon sight includes determining a boresight adjustment of the peripheral by adding the mount offset to the peripheral offset; and shifting data received from the peripheral relative to image data received from the digital weapon sight by the boresight adjustment.

19. The method as recited in claim 18, further comprising displaying the shifted data and image data on a display.

* * * * *